US009939161B2

(12) United States Patent
Jeong et al.

(10) Patent No.: US 9,939,161 B2
(45) Date of Patent: Apr. 10, 2018

(54) COOKING APPLIANCE

(71) Applicant: LG ELECTRONICS INC., Seoul (KR)

(72) Inventors: Yongki Jeong, Seoul (KR); Janghee Park, Seoul (KR); Jaebeom Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 586 days.

(21) Appl. No.: 14/519,729

(22) Filed: Oct. 21, 2014

(65) Prior Publication Data

US 2015/0107576 A1 Apr. 23, 2015

(30) Foreign Application Priority Data

Oct. 21, 2013 (KR) ..... 10-2013-0125501

(51) Int. Cl.
*F24C 15/32* (2006.01)
*F24C 3/08* (2006.01)

(52) U.S. Cl.
CPC ..... *F24C 15/322* (2013.01); *F24C 3/087* (2013.01)

(58) Field of Classification Search
USPC ..... 126/39 C, 21 A
See application file for complete search history.

(56) References Cited

U.S. PATENT DOCUMENTS 3,063,441 A * 11/1962 Stoligrosz ..... F24C 3/047 126/21 A
4,357,522 A * 11/1982 Husslein ..... F24C 15/325 126/21 A
4,498,453 A * 2/1985 Ueda ..... F24C 15/322 126/21 A
5,568,803 A * 10/1996 Brown ..... F24C 15/322 126/21 A
5,601,070 A * 2/1997 Hotard ..... F24C 15/322 126/21 A
6,603,102 B2 * 8/2003 Brown ..... B65B 61/205 126/21 A
7,329,838 B2 * 2/2008 Song ..... F24C 15/325 126/21 A
7,491,914 B2 * 2/2009 Kim ..... F24C 15/325 126/21 A
2003/0111069 A1 * 6/2003 Austin ..... F24C 15/322 126/21 A
2003/0140917 A1 * 7/2003 Rummel ..... F24C 15/322 126/21 A
2003/0172919 A1 * 9/2003 Rabas ..... F24C 15/322 126/21 A
2005/0224064 A1 * 10/2005 Stockley ..... F24C 15/16 126/21 R (Continued)

*Primary Examiner* — Avinash Savani
(74) *Attorney, Agent, or Firm* — Dentons US LLP

(57) ABSTRACT

Provided is a cooking appliance. The cooking appliance includes a housing to define a cooking chamber, a burner disposed outside the housing, a communication hole defined in the housing to allow air heated by the burner to pass therethrough, and a heated air guider disposed inside the housing and coupled to the housing. The heated air guider comprises a discharge hole through which the heated air is discharged and prevents the communication hole from being exposed to the cooking chamber.

12 Claims, 6 Drawing Sheets

(56) References Cited

U.S. PATENT DOCUMENTS

| | | | | |
|---|---|---|---|---|
| 2006/0131298 | A1* | 6/2006 | Seuk Oh | F24C 15/325<br>219/400 |
| 2009/0090347 | A1* | 4/2009 | Kim | F24C 15/325<br>126/21 A |
| 2011/0186031 | A1* | 8/2011 | Kim | F24C 15/322<br>126/21 A |
| 2013/0008426 | A1* | 1/2013 | Newsom | F24C 15/325<br>126/21 A |
| 2014/0137853 | A1* | 5/2014 | Murray | F24C 15/322<br>126/21 A |

* cited by examiner

COOKING APPLIANCE

CROSS-REFERENCE TO RELATED APPLICATIONS

The present application claims priority under 35 U.S.C. 119 and 35 U.S.C. 365 to Korean Patent Application No. 10-2013-0125501 (filed on Oct. 21, 2013), which is hereby incorporated by reference in its entirety.

BACKGROUND

The present disclosure relates to a cooking appliance.

In general, cooking appliances are device for cooking foods by using heat generated from a heat source.

A gas oven that is an example of the cooking appliances may heat foods by using combustion heat, radiant heat, and conductive heat which are generated by combustion of a gas while the supplied gas is burnt.

SUMMARY

Embodiments provide a cooking appliance.

In one embodiment, a cooking appliance includes: a housing to define a cooking chamber; a burner disposed outside the housing; a communication hole defined in the housing to allow air heated by the burner to pass therethrough; and a heated air guider disposed inside the housing and coupled to the housing, wherein the heated air guider comprises a discharge hole through which the heated air is discharged and prevents the communication hole from being exposed to the cooking chamber.

In another embodiment, a cooking appliance includes: a housing to define a cooking chamber; a burner disposed outside the housing; a communication hole defined in the housing to allow the cooking chamber to communicate with a space in which the burner is disposed; and a heated air guider disposed within the housing to discharge air passing through the communication hole into the cooking chamber, wherein the communication hole is covered by the heated air guider.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
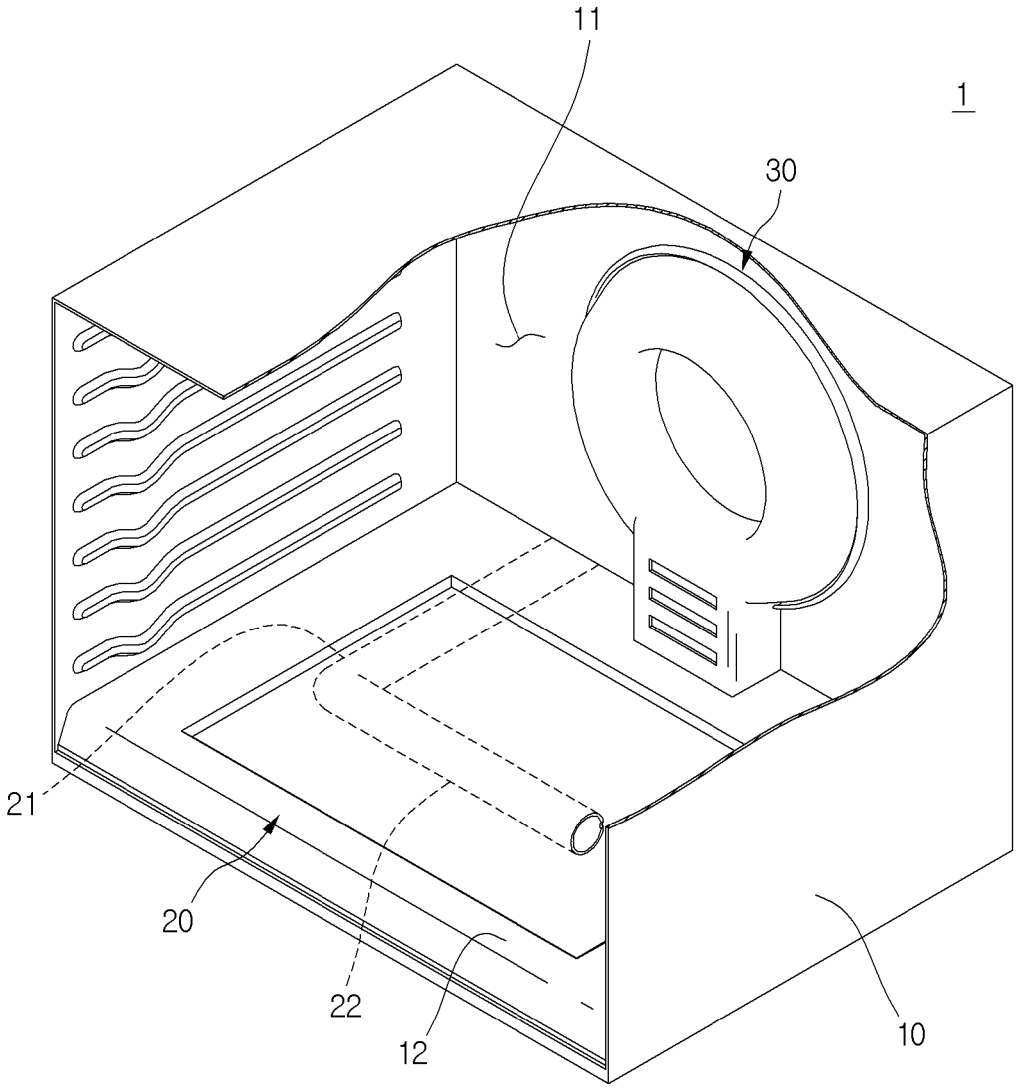
FIG. 1 is a schematic view of a cooking appliance according to an embodiment.
Figure 2:
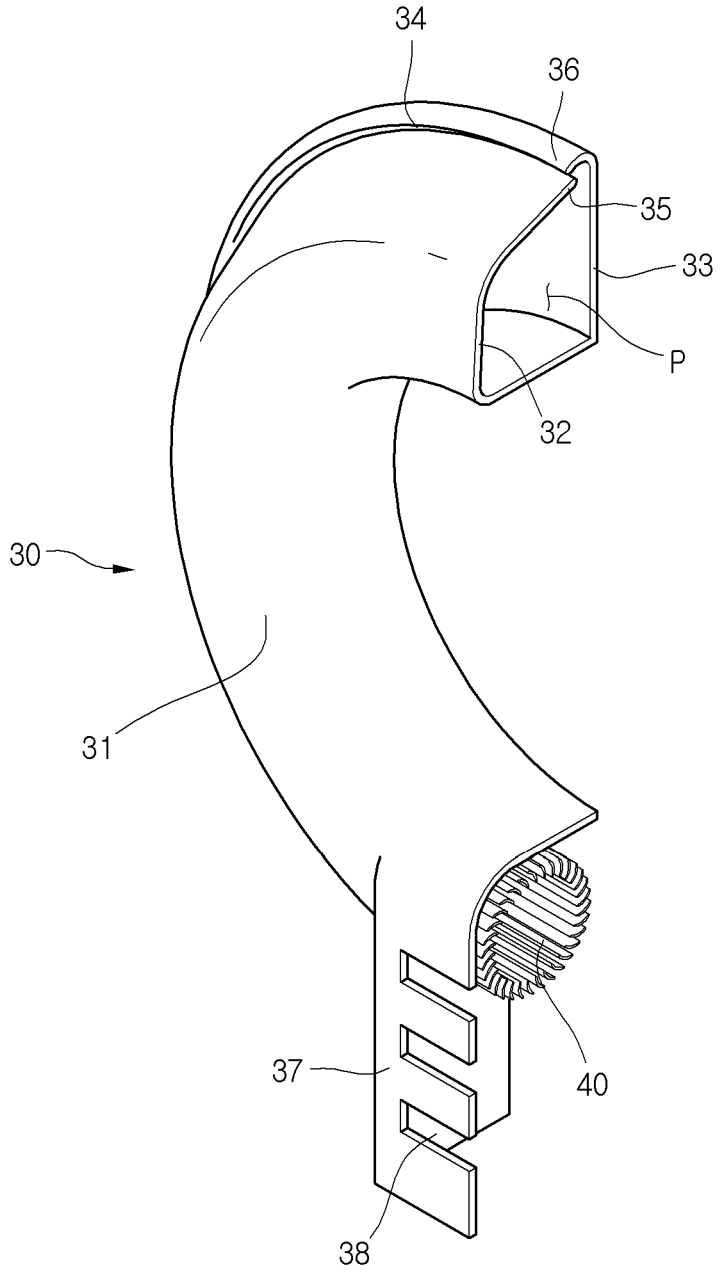
FIG. 2 is a cross-sectional view of a heated air guider for guiding heated air.
Figure 3:
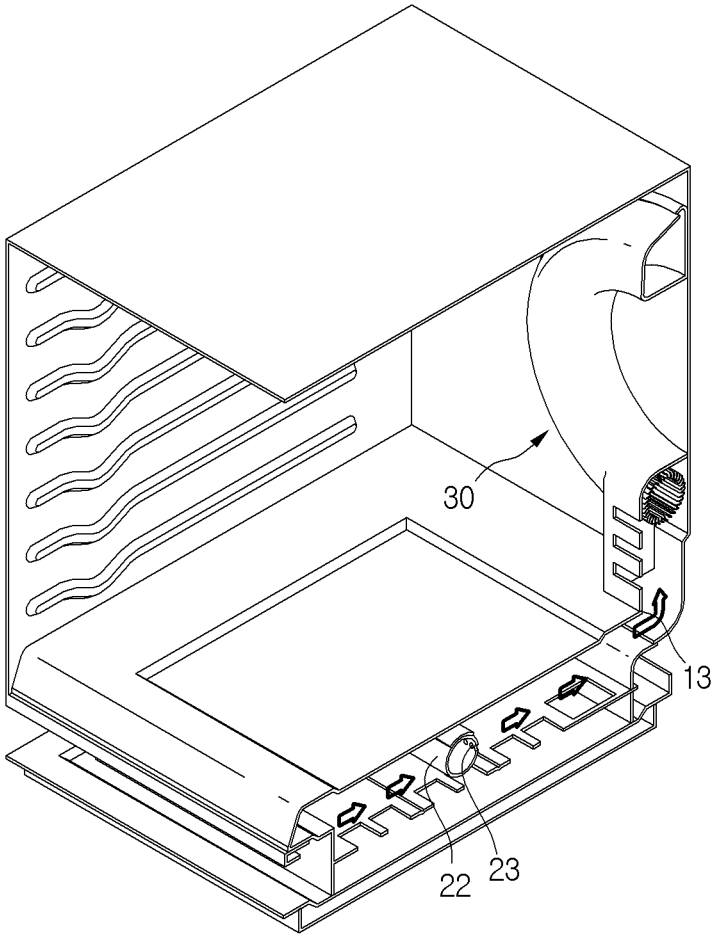
FIG. 3 is a partial cross-sectional view of the cooking appliance according to an embodiment.
Figure 4:
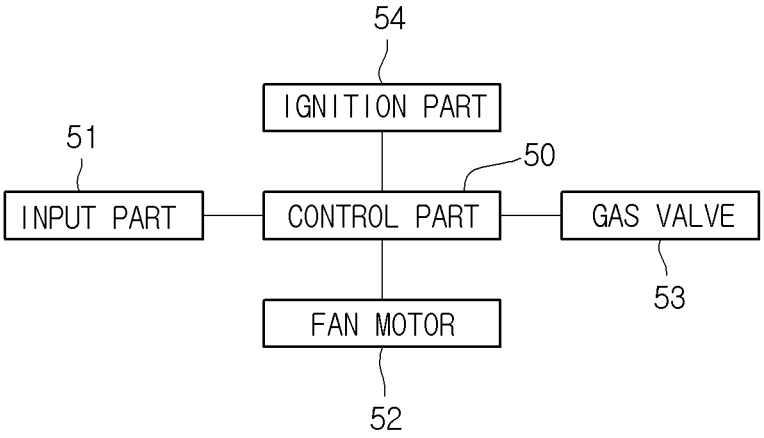
FIG. 4 is a block diagram of the cooking appliance according to an embodiment.

FIG. 1 is a schematic view of a cooking appliance according to an embodiment, FIG. 2 is a cross-sectional view of a heated air guider for guiding heated air, FIG. 3 is a partial cross-sectional view of the cooking appliance according to an embodiment, and FIG. 4 is a block diagram of the cooking appliance according to an embodiment.

Referring to FIGS. 1 to 4, a cooking appliance 1 according to an embodiment may include a housing 10 defining a cooking chamber 11.

The housing 10 may have a front side with an opened rectangular shape, but is not limited thereto. The cooking chamber 11 may be opened or closed by a door (not shown).

The housing 10 may include a base 12 defining a bottom surface thereof. A burner 20 that is a heat source for heating a food received in the cooking chamber 11 may be disposed under the base 12. Substantially, the cooking appliance 1 may further include an outer case (not shown) protecting the housing 10. The burner 20 may be disposed between the base 12 and the outer case.

The burner 20 may heat air within a space in which the burner 20 is disposed. The heated air may be supplied into the cooking chamber 11 by a heated air guider 30 to cook the food.

The burner 20 may include a supply part 21 extending in a direction that is away from the heated air guider 30 and a combustion part 22 bent from the supply part 21.

For example, the supply part 21 may extend in a front/rear direction, and the combustion part 22 may extend in a left/right direction of the housing 10.

The supply part 21 may be connected to a gas supply tube (not shown). A gas valve 53 may be disposed in the gas supply tube. The gas valve 53 may be opened or closed by a control part 50.

A plurality of flame holes 23 in which flame is generated may be defined in the combustion part 22. An ignition part 54 for igniting a gas may be disposed at a position adjacent to the burner 20.

Although not shown, an additional heat source may be further disposed inside or outside the cooking chamber 11. The additional heat source may be, for example, a burner, but is not limited thereto.

The heated air guider 30 for guiding air heated by the burner 20 into the cooking chamber 11 may be coupled to a rear wall of the housing 10. The heated air guider 30 may be coupled to the rear wall of the housing 10 within the cooking chamber 11.

The heated air guider 30 may include a first body 31 and a second body 37.

For example, the first body 31 may have a ring shape. Alternatively, the first body 31 may have a polygonal ring shape. Although the first body 31 having the ring shape is provided in FIG. 1, the present disclosure is not limited to the shape of the first body 31. A hole may be defined in a central portion of the first body 31.

The first body 31 may include a rounded first guide 32 and a second guide 33 connected to the first guide 32. The second guide 33 may have, for example, a flat plate shape. Also, the second guide 33 may have a rounded one end. The second guide 33 may be coupled to the rear wall of the housing 10.

The first guide 32 and the second guide 33 may define a heated air passage P and a first discharge hole 34 through which the heated air is discharged.

An end 35 of the first guide 32 and an end 36 of the second guide 33 may be spaced apart from each other to define the first discharge hole 34. The one end 35 of the first guide 32 and the one end 36 of the second guide 33 may overlap each other in a radius direction of the first body 31.

Also, the one end 36 of the second guide 33 may disposed to surround the one end 35 of the first guide 32. Also, the one end 36 of the second guide 33 may be rounded forward to guide air into a front side of the cooking chamber 11.

The first discharge hole 34 may be defined around a portion of the first body 31 except for a portion of the first body 31 that is connected to the second body 37. The first discharge hole 34 may be defined in an area that rotates at an angle of about 270° or more with respect to a center of the first body 31 to uniformly supply the heated air into the cooking chamber 11.

Also, since the second guide 33 and the first guide 32 define the first discharge hole 34, the second guide 33 may also be coupled to the first guide 32 on an area that rotates at an angle of about 270° or more with respect to the center of the first body 31.

The second body 37 may extend downward from the first body 31. Particularly, the second body 37 may be integrated with the first guide 32.

Also, the second body 37 may have an opened rear side. The opened portion of the second body 37 may be covered by the rear wall of the housing 10. That is, the second body 37 may have a horizontal cross-section having, for example, a "ㄴ" or "C" shape, but is not limited thereto. Alternatively, the horizontal cross-section of the second body 37 may form a close loop.

The second body 37 may have a lower end contacting the base 12 of the housing 10.

A communication hole 13 through which the air heated by the burner 20 passes may be defined in the base 12 of the housing 10. The communication hole 13 may be covered by the second body 37. That is, the communication hole 13 may be defined in an area of the base 12 that corresponds to that in which the second body 37 is disposed. Also, the communication hole 13 may not be exposed to the cooking chamber 11.

Alternatively, a communication hole through the air heated by the burner 20 passes may be defined in the rear wall of the housing 10. The communication hole may be covered by the second body 37.

According to the present embodiment, the communication hole 13 may not be exposed to the cooking chamber 11 by the second body 37. Thus, it may prevent food leftovers generated while cooking foods from being introduced into a space, in which the burner 20 is disposed, through the communication hole 13.

Also, since the communication hole 13 is not exposed to the cooking chamber 11, it may prevent a cleaning solution that is used while the housing 10 is cleaned or food leftovers removed from the housing 10 from passing through the communication hole 13.

Also, if the cooking appliance additionally includes a steam generator as a heat source, it may prevent steam supplied into the cooking chamber 11 from having an influence on the flame of the burner 20.

At least one second discharge hole 38 through the heated air is discharged may be defined in the second guide 37.

A cross flow fan 40 for a flow of the heated air may be disposed at the connection portion between the first body 31 and the second body 37 or within the second body 37. The cross flow fan 40 may be horizontally disposed.

The cross flow fan 40 may be disposed at a downstream side of the second discharge hole 38 and disposed at an upstream side of the first discharge hole 34. Thus, the heated air flowing by the cross flow fan 40 may be discharged into the cooking chamber 11 through the second discharge hole 38 before passing through the cross flow fan 40. Also, the heated air passing through the cross flow fan 40 may be discharged into the cooking chamber 11 through the first discharge hole 34.

According to the present embodiment, since the cross flow fan is provided as a kind of fan for the flow of the heated air, air may flow even though the fan has a small size.

A fan motor 53 for rotating the cross flow fan 40 may be disposed within the heated air guider 30. For example, the cross flow fan 40 may be directly connected to a shaft of the fan motor 52. In this case, a wire for supplying a power into the fan motor 52 may be connected to the fan motor 52 by passing through the rear wall of the housing 10. Also, the fan motor 52 may be supported by a motor bracket (not shown). The motor bracket may be disposed inside the second body 37.

For another example, the fan motor 52 may be disposed outside the housing 10, and the shaft of the fan motor 52 may pass through the rear wall of the housing 10. Also, a plurality of gears that is a power transmission part for transmitting a power into the fan motor 52 may be disposed within the heated air guider 30.

The cooking appliance 1 may further include an input part 51 for selecting a cooking mode.

The cooking mode may include a first mode and a second mode. The first mode may be a mode in which the heated air flows by rotation of the cross flow fan 40. The second mode may be a mode in which the heated air flows by natural convection without the air flow by the cross flow fan 40.

Thus, the control part 50 may control an operation of the fan motor 52 according to the mode selected through the input part 51.

Of cause, an additional mode except for the first and second modes may be selected through the input part 51. In each of the first and second modes, the burner 20 may be used for cooking a food. Also, in the additional mode except for the first and second modes, the burner 20 may not be used.

Figure 5:
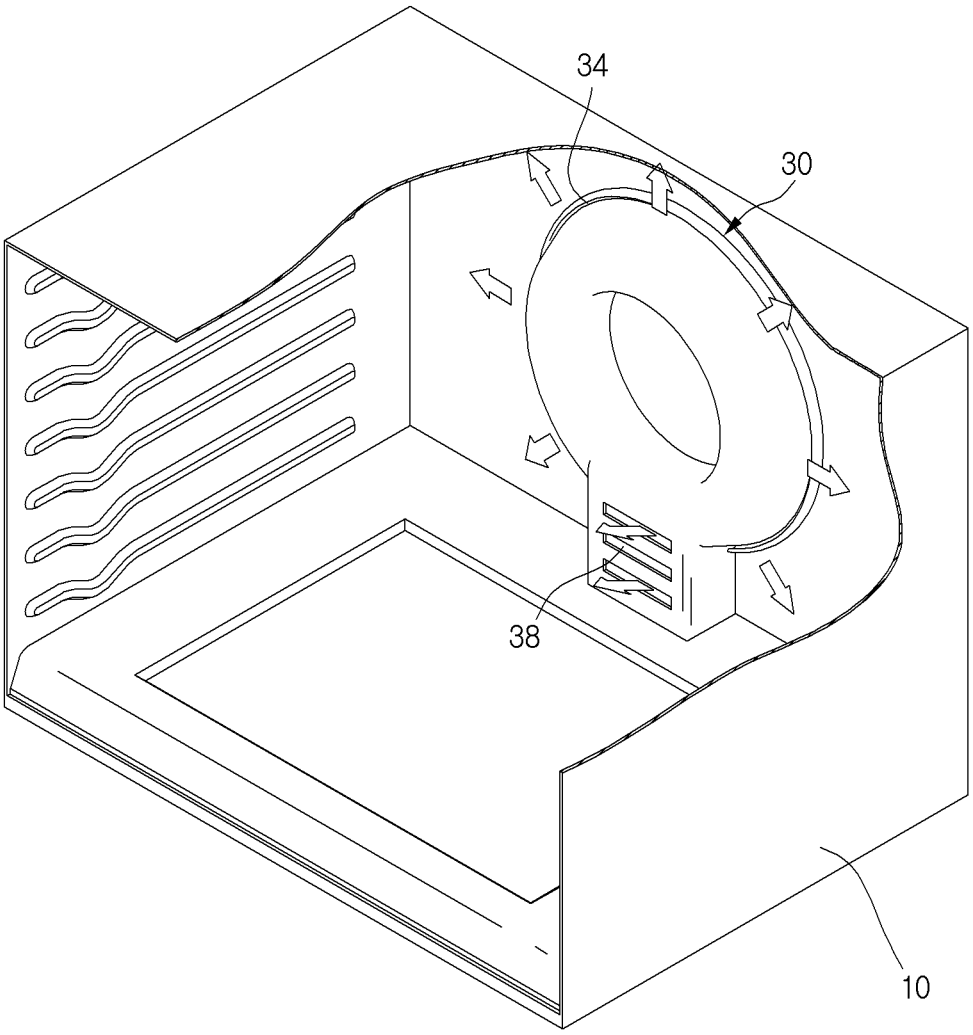
FIG. 5 is a view illustrating a flow of heated air in a first mode.
Figure 6:
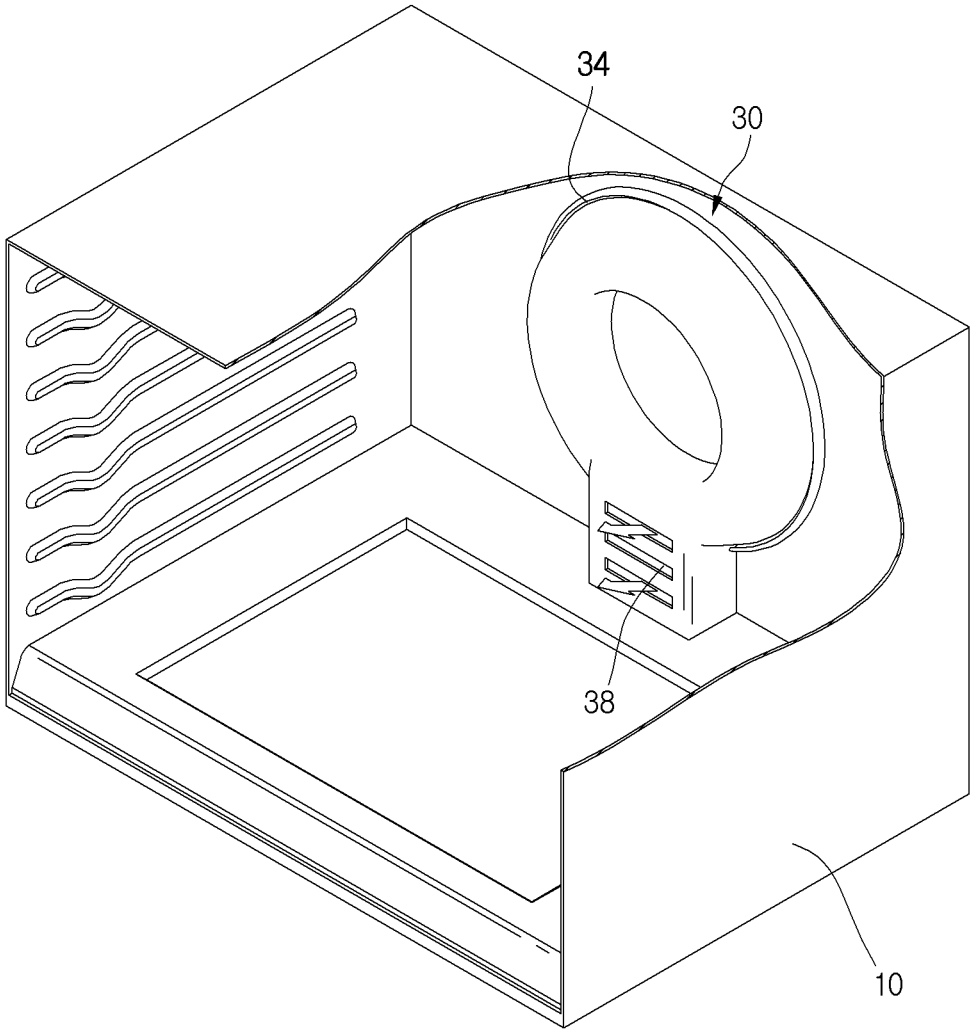
FIG. 6 is a view illustrating a flow of heated air in a second mode.

FIG. 5 is a view illustrating a flow of heated air in a first mode, and FIG. 6 is a view illustrating a flow of heated air in a second mode.

First, referring to FIGS. 3 and 5, the control part 50 may determine a mode inputted through the input part 51 to control an operation of the fan motor 52.

If it is determined that the first mode is selected through the input part 51, the control part 50 may operate the fan motor 52.

In the first mode, the air heated by the burner 20 may flow into the heated air guider 30 through the communication hole 13 by a rotation force of the fan motor 52.

A portion of the heated air introduced into the heated air guider 30 may be discharged into the cooking chamber 11 through the second discharge hole 38 of the second body 37. Here, since the air passing through the communication hole 13 passes through the second discharge hole 38 while flowing upward, the air discharged through the second discharge hole 38 may flow toward an upper wall of the housing 10.

The other portion of the heated air introduced into the heated air guider 30 may flow into the air passage P of the first body 31 after passing through the cross flow fan 40 and then be discharged into the cooking chamber 11 through the first discharge hole 34 in the air passage P.

If it is determined that the second mode is selected through the input part 51, the control part 50 may control the fan motor 52 so that the fan motor 52 is stopped (or maintained to a stopped state).

In the second mode, the air heated by the burner 20 may flow into the heated air guider 30 through the communication hole 13 by the natural convection.

Most of the heated air introduced into the heated air guider 30 may be discharged into the cooking chamber 11 through the second discharge hole 38 of the second body 37. Here, a portion of the heated air introduced into the heated air guider 30 may be discharged into the cooking chamber 11 through the first discharge hole 34. However, since the cross flow fan 40 is disposed at the upstream side of the first discharge hole, the cross flow fan 40 may serve as flow resistance, and thus, an amount of heated air discharged through the first discharge hole 34 may be relatively small.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance, comprising:

a housing comprising a cooking chamber, the housing having a base defining a bottom surface thereof;

a burner disposed under the base of the housing;

a communication hole at the housing allowing air, heated by the burner, to pass therethrough; and a heated air guider coupled to the interior of the housing, wherein the heated air guider comprises at least one discharge hole through which heated air is discharged into the cooking chamber and which prevents the communication hole from being exposed to the cooking chamber, and wherein the heated air guider further comprises:

a first body having a first discharge hole; and a second body extending downward from the first body, the second body having a second discharge hole, wherein the second body is in contact with the base and covers the communication hole, wherein the first body includes a rounded first guide and a second guide connected to the first guide, wherein an end of the first guide and an end of the second guide are spaced apart from each other to define the first discharge hole, and wherein the one end of the second guide is disposed to surround the one end of the first guide.

2. The cooking appliance of claim 1, wherein the communication hole is located on a rear wall of the housing, and the heated air guider is coupled to the rear wall of the housing.

3. The cooking appliance of claim 1, wherein a fan, located within the heated air guider, discharges the heated air into the cooking chamber.

4. The cooking appliance of claim 3, wherein the fan comprises a cross flow fan.

5. The cooking appliance of claim 4, wherein the cross flow fan is horizontally disposed within the heated air guider.

6. The cooking appliance of claim 3, wherein the fan is located where the first body and the second body are connected to each other or on the second body.

7. The cooking appliance of claim 3, wherein the fan is located at an upstream side of the first discharge hole or a downstream side of the second discharge hole.

8. The cooking appliance of claim 3, wherein the first body has a closed loop shape with a central hole, and the first discharge hole is defined around the first body.

9. The cooking appliance of claim 8, wherein the first discharge hole is defined in an area that rotates an angle of about 270° with respect to a center of the first body.

10. The cooking appliance of claim 3, further comprising:

an input part to indicate a cooking mode;

a fan motor to rotate the fan; and a control part to control the fan motor according to the cooking mode indicated by the input part, wherein the cooking mode comprises a first mode and a second mode, and wherein the control part operates the fan motor to discharge heated air into the cooking chamber by the fan when the first mode is selected and stops the operation of the fan motor to discharge heated air into the cooking chamber by natural convection when the second mode is selected.

11. The cooking appliance of claim 1, wherein the burner comprises:

a supply part extending in a direction away from the heated air guider; and a combustion part connected to the supply part, the combustion part having a plurality of flame holes.

12. The cooking appliance of claim 11, wherein the heated air guider is coupled to a rear wall of the housing, the supply part extends in a front and rear direction of the housing, and the combustion part extends in a left and right direction of the housing.

* * * * *